US008443861B2

(12) United States Patent
Demange et al.

(10) Patent No.: US 8,443,861 B2
(45) Date of Patent: May 21, 2013

(54) MARKING OR LABELING MACHINE AND A MARKING OR LABELING METHOD

(75) Inventors: Florent Demange, Valleiry (FR); Marco Paita, Oyonnax (FR); David Mandon, Oyonnax (FR)

(73) Assignee: Illinois Tool Works Inc., Glenview, IL (US)

( * ) Notice: Subject to any disclaimer, the term of this patent is extended or adjusted under 35 U.S.C. 154(b) by 237 days.

(21) Appl. No.: 12/772,670

(22) Filed: May 3, 2010

(65) Prior Publication Data

US 2010/0282402 A1 Nov. 11, 2010

(30) Foreign Application Priority Data

May 6, 2009 (FR) ..... 09 53019

(51) Int. Cl.
*B65C 9/18* (2006.01)

(52) U.S. Cl.
USPC ..... 156/542; 156/552; 156/556

(58) Field of Classification Search
USPC ..... 101/216, 219, 243, 38.1, 39, 40, 101/40.1; 156/542, 552, 556, 567, 568; 242/474.5, 474.6
See application file for complete search history.

(56) References Cited

U.S. PATENT DOCUMENTS

| | | | | |
|---|---|---|---|---|
| 6,164,199 | A | 12/2000 | Dubuit et al. | |
| 2005/0066826 | A1 | 3/2005 | Dubuit et al. | |
| 2005/0230221 | A1 * | 10/2005 | Guglielmo et al. | 198/459.2 |
| 2008/0023296 | A1 * | 1/2008 | Aoyama et al. | 198/468.2 |
| 2009/0178581 | A1 | 7/2009 | Paita et al. | |

FOREIGN PATENT DOCUMENTS

| | | |
|---|---|---|
| GB | 1558536 | 1/1980 |

* cited by examiner

*Primary Examiner* — Katarzyna Wyrozebski Lee
*Assistant Examiner* — Scott W Dodds
(74) *Attorney, Agent, or Firm* — Dowell & Dowell, PC

(57) ABSTRACT

A marking or labeling machine which includes at least one marking or labeling member and a feed mechanism for bringing workpieces for marking or labeling into register with the at least one marking or labeling member. The feed mechanism includes at least two arms mounted to turn about a common first axis, with each arm carrying at least one support member for supporting a workpiece for marking or labeling, and also includes secondly independent drives for driving each of the arms in rotation about the common first axis independently of the other arm.

9 Claims, 14 Drawing Sheets

MARKING OR LABELING MACHINE AND A MARKING OR LABELING METHOD

BACKGROUND OF THE INVENTION

1. Field of the Invention

The present invention relates to a marking or labeling machine that includes a member such as a punch that is designed to press a ribbon against the peripheral surface of a workpiece for marking or labeling. The invention also relates to a marking or labeling method in which workpieces are successively brought into register with a marking member, such as a punch, or into register with a label applicator member.

2. Description of the Related Art

In the field of hot-marking, it is known, e.g. from WO-A-2008/142225, that it is possible to use a punch to press a marking ribbon against the peripheral surfaces of workpieces for marking that are mounted on six cores carried by a turntable. Those cores go successively to a loading position, to a marking position, to an inspection position, and to an unloading position, as well as to various intermediate positions. The speed at which the workpieces are marked depends on the mean speed of rotation of the turntable, which speed is, in practice, limited by the various operations that need to be performed on the workpieces for marking or that have already been marked, while the turntable is at a standstill.

It is also known from GB-A-1 558 536 to move cups between various stations in a print machine by means of four intermediate members hinged about a central axle and each of which is connected to the axle of a respective planet gear wheel. The various planet gear wheels interact, one after another, with a ramp of a cam that also turns about the central axle. The movements of the various intermediate members are interdependent insofar as a single cam is used to move said intermediate members, it being possible for said cam to interact with any one of the intermediate members only once said cam has already left or while it is leaving another intermediate member. The movements of two planet gear wheels overlap in time, but cannot take place at the same time, due to the fact that the single cam can take up only one angular position about the central axle at any one time.

Analogous problems arise with other marking machines, in particular screen-printing marking machines, and with labeling machines.

SUMMARY OF THE INVENTION

More particularly, an object of the invention is to remedy those drawbacks by proposing a novel marking or labeling machine of productivity that is significantly improved compared with prior art marking and labeling machines.

To this end, the invention provides a marking or labeling machine comprising at least one marking or labeling member, and feed means for bringing each workpiece for marking or labeling into register with the marking or labeling member, said feed means comprising at least two arms mounted to turn about a common first axis, and each carrying at least one member for supporting a workpiece for marking or labeling. According to the invention, the feed means further comprise independent means for driving each of the arms in rotation about the common first axis independently of the other arm.

By means of the invention, time can be saved by moving each arm while the other arm(s) is/are involved in one or more other operations. In other words, one of the arms can be moving a workpiece for marking or that has already been marked, or a workpiece for labeling or that has already been labeled, while the other arm is in a station in which action is being taken on another workpiece, such as a loading station, a marking station, an inspection station, or an unloading station. This is particularly advantageous because the lengths of time for which an arm remains stationary in any one of the above-mentioned stations vary as a function of the operations to be performed. The independence of the means for driving the arms in rotation about the first axis thus makes it possible for each arm to move independently from the other arm(s), at its own speed between the various stations, without hindering the actions being taken on the workpieces supported by the other arm(s). By means of appropriate control, a machine of the invention that has two independent arms makes it possible to process workpieces for marking or for labeling at a processing speed comparable to the speed procured with a machine equipped with a turntable on which six cores are mounted, which is advantageous in terms both of the cost of the machine and also of the inertia of the moving masses, and thus of the lifetime of the machine.

In advantageous but non-essential aspects of the invention, such a machine may incorporate one or more of the following characteristics, taken in any technically feasible combination:

- the independent means for driving the arms in rotation about the first axis comprise at least two electric motors, each of which is dedicated to driving a respective arm in rotation about the first axis, and both of which are supported by a stationary frame of the machine;
- the machine further comprises means for driving each support member in rotation about a second axis that is parallel to the first axis;
- the means for driving a support carried by a first arm in rotation about a second axis are independent from the means for driving another support carried by a second arm in rotation about a second axis;
- the means for driving a support member carried by an arm in rotation about a second axis comprise a shaft centered on the first axis and drivingly connected firstly to an electric actuator and secondly to the support member; in which case, the link between the electric actuator and the shaft and/or the link between the shaft and the support member is advantageously implemented by a flexible link, such as a belt or a chain;
- the means for driving a support member carried by an arm in rotation about a second axis comprise an electric motor mounted on the arm; in which case, the electric motor mounted on the arm is advantageously controlled by at least one control member mounted on a support that is mounted to turn about a first axis, while an electric actuator is suitable for driving the support in rotation about a first axis, at a speed equal to the mean of the speeds of rotation of the arms over one turn; and
- at least one of the arms carries two support members for supporting respective workpieces for marking, on either side of the first axis.

The invention also provides a marking or labeling method that can be implemented with a machine as described above, and, more specifically, a method in which workpieces for marking or labeling are brought successively into register with at least one marking or labeling member. This method is characterized in that it comprises steps consisting in:

a) loading a workpiece onto a support member carried by an arm that is part of a set of a plurality of arms mounted to turn about a first axis;

b) causing the arm on which the workpiece is loaded to turn about the first axis, until the workpiece comes into register with the marking or labeling member, independently of the movement of the other arm(s) of the set of arms;

c) causing the support member and the workpiece to turn relative to the arm about a second axis that is parallel to the first axis;

d) marking the workpiece by using the marking member, or affixing a label on the peripheral surface of the workpiece for labeling, by using the labeling member;

e) causing the arm to turn about the first axis until the workpiece is at an unloading station, independently of the movement of the other arm(s) of the set of arms; and f) unloading the workpiece from the support member.

In this method, each arm moves the workpiece, for marking or already marked, independently of the other arms, while also enabling it to be driven in rotation about the first and second axes, thereby saving time during the marking.

BRIEF DESCRIPTION OF THE DRAWINGS

The invention can be better understood and other advantages of the invention appear more clearly from the following description of four embodiments of a machine that complies with the principle of the invention, and of a method of using said machine, the description being given merely by way of example and with reference to the accompanying drawings, in which.

DETAILED DESCRIPTION OF THE PREFERRED EMBODIMENTS OF THE INVENTION

Figure 1:
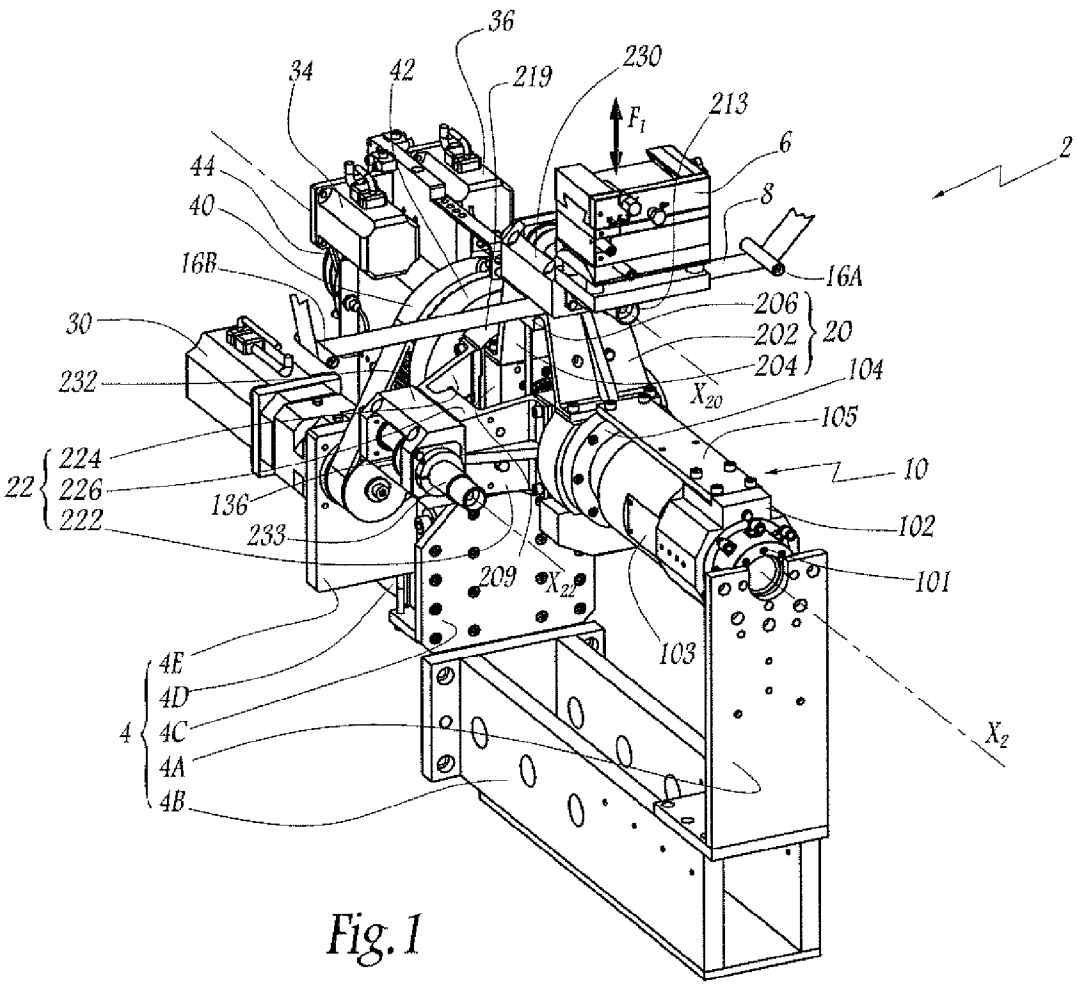
FIG. 1 is a fragmentary perspective view of a marking machine of the invention.

In order to make the drawing clearer, the marking ribbon of the machines of FIGS. 9 to 16 is not shown.

Figure 2:
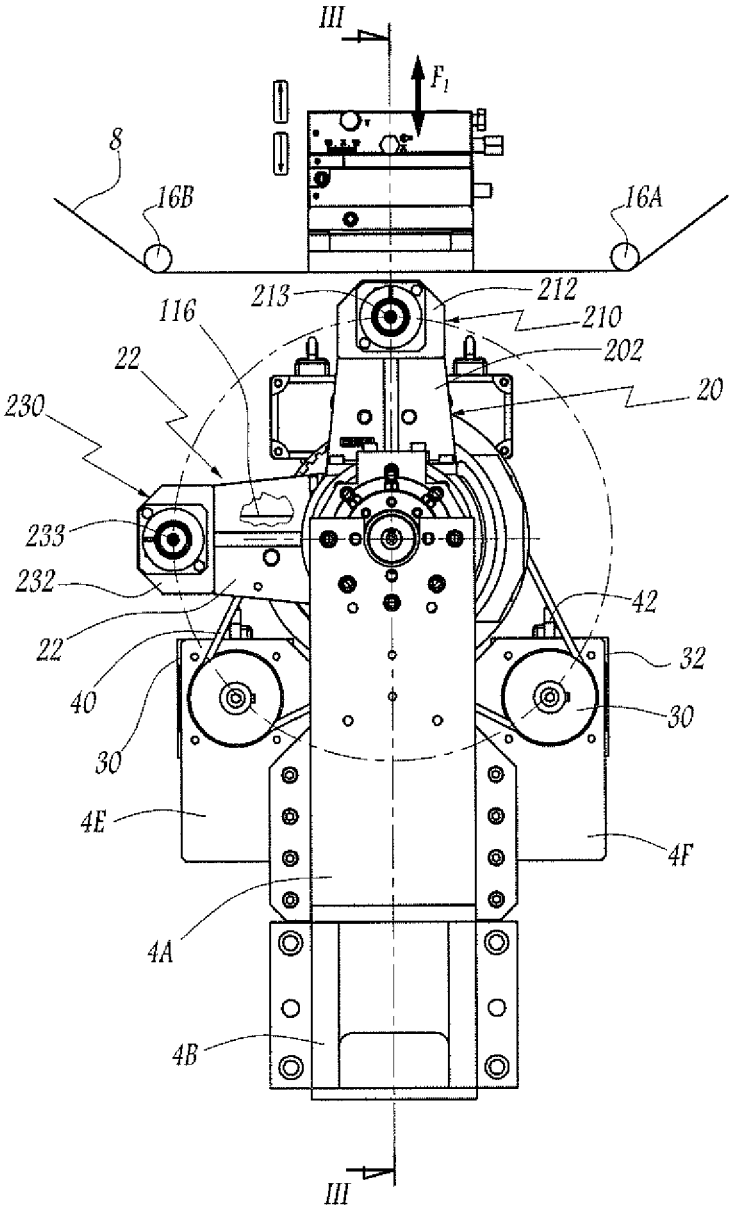
FIG. 2 is a partially cutaway front view of the machine of FIG. 1.
Figure 3:
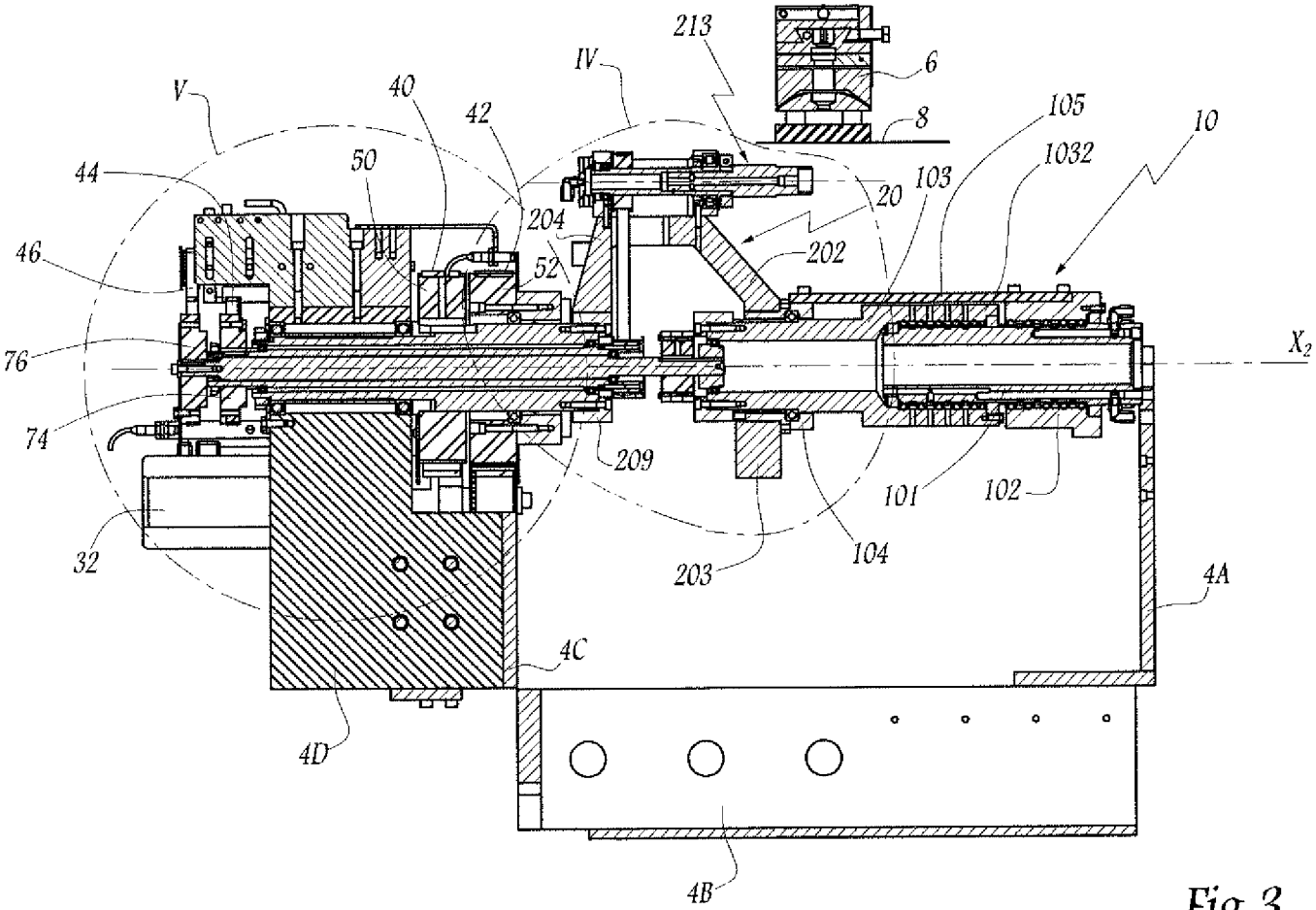
FIG. 3 is a section view on line III-III of FIG. 2.

The machine 2 shown in FIGS. 1 to 7 comprises a stationary frame 4 and a punch 6 that is of the hot punch type and that is mounted to move vertically as indicated by the double-headed arrow $F_1$ in FIGS. 1 and 2. This hot punch 6 is designed to press a ribbon 8 onto the outside surfaces of workpieces for marking, such as perfume bottles or cosmetics bottles, such bottles being cylindrical in overall shape, and most often of circular section. In order to clarify the drawing, the workpieces are not shown in the figures, except for one workpiece in FIG. 4.

The ribbon 8 extends between a feed reel and a used ribbon take-up reel, which reels are known per se and are not shown. The ribbon 8 is guided by deflector rollers 16A and 16B.

In order to bring the workpieces for marking into register with the punch 6, the machine 2 is equipped with two arms 20 and 22 that are mounted to move in rotation about a common axis $X_2$ that is defined by the frame 4 and that is perpendicular to the direction of movement of the punch 6, i.e. horizontal in the example shown in the figures.

Figure 8:
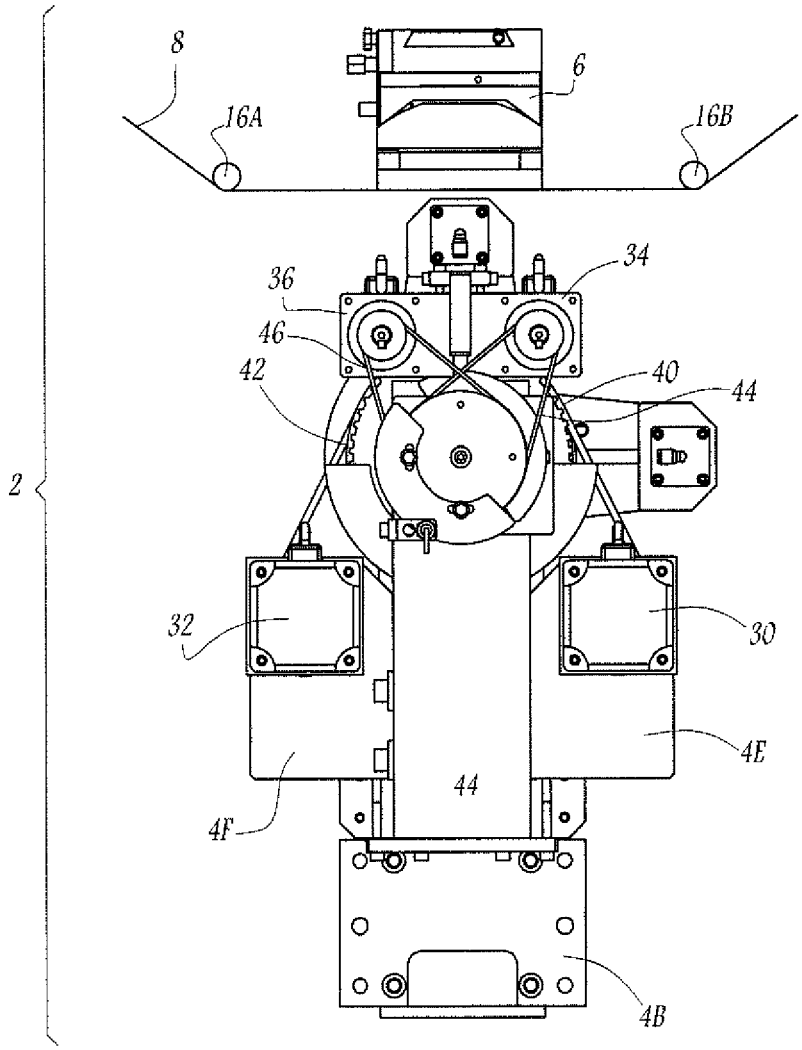
FIG. 8 is a back view of the machine of FIGS. 1 to 7.
Figure 9:
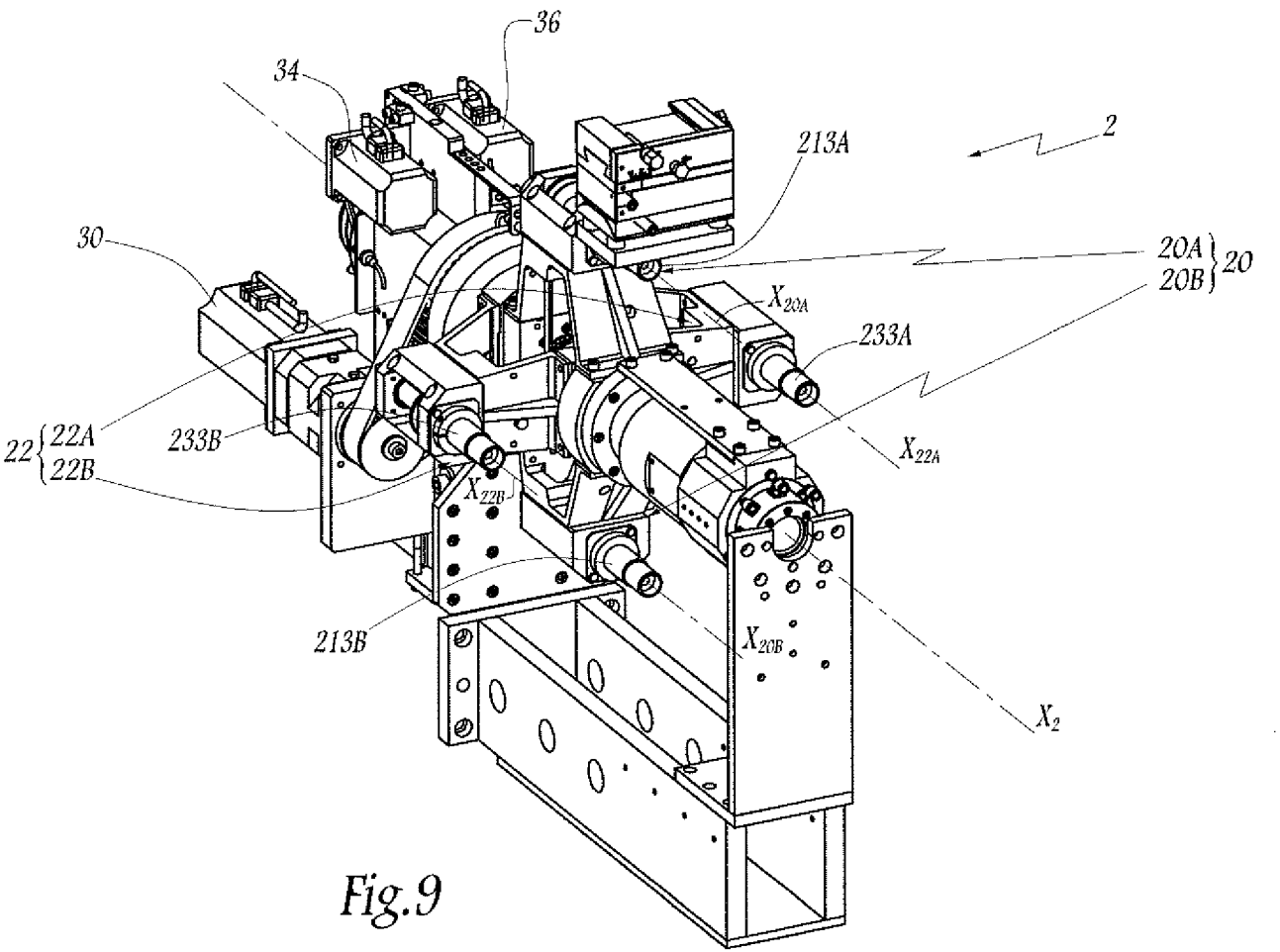
FIG. 9 is a perspective view analogous to FIG. 1 for a second embodiment of a machine the invention.

In the present description, the terms "front" and "back" are used considering the machine 2 seen as shown in FIG. 1 and having its front facing the observer of FIG. 1. In other words, the front of the machine is visible in FIG. 2 and in the right portion of FIG. 3, while the back of the machine is visible in FIG. 8 and in the left portion of FIG. 3.

The frame 4 comprises a front plate 4A, a longitudinal girder 4B, a back plate 4C and a supporting structure 4D, all of which are stationary. A rotary manifold 10 is mounted on the plate 4A and is fed with pressurized air to be distributed between the various pneumatic members of the machine 2. The manifold comprises a stationary core 101 provided with a central orifice and with a plurality of ducts through which pressurized air flows towards grooves provided at the periphery of said core. A first ring 102 is mounted around the core 101, while being movable in rotation about the axis $X_2$. A hollow shaft 103 is mounted in alignment with the core 101, along the axis $X_2$, and has an end 1032 that surrounds the core 101 in part, while being movable in rotation about the axis $X_2$. A second ring 104 is mounted around the shaft 103 while being movable in rotation about the axis $X_2$. A plate 105 interconnects the two rings 102 and 104 by being secured to each of them by means of screws, so that said rings can turn together about the axis $X_2$, and about the elements 101 and 103. A bearing 120 is interposed between the ring 104 and the shaft 103. A sleeve 106 is constrained to move in rotation with the ring 104.

The arm 20 comprises a front plate 202 and a back plate 204 that are interconnected via a plateau 206 provided with an opening 208. The arm 202 is mounted on the sleeve 106 that is itself supported by the bearing 120 relative to the shaft 103.

The arm 20 carries a piece of equipment 210 for supporting a workpiece for marking, which piece of equipment comprises a housing 212, a hollow core 213 and two bearings 214 and 215 for supporting the hollow shaft 213 relative to the to the housing 212, while enabling said shaft to move in rotation about an axis $X_{20}$ defined by the housing 212, which axis is parallel to the axis $X_2$ and distinct therefrom.

Figure 4:
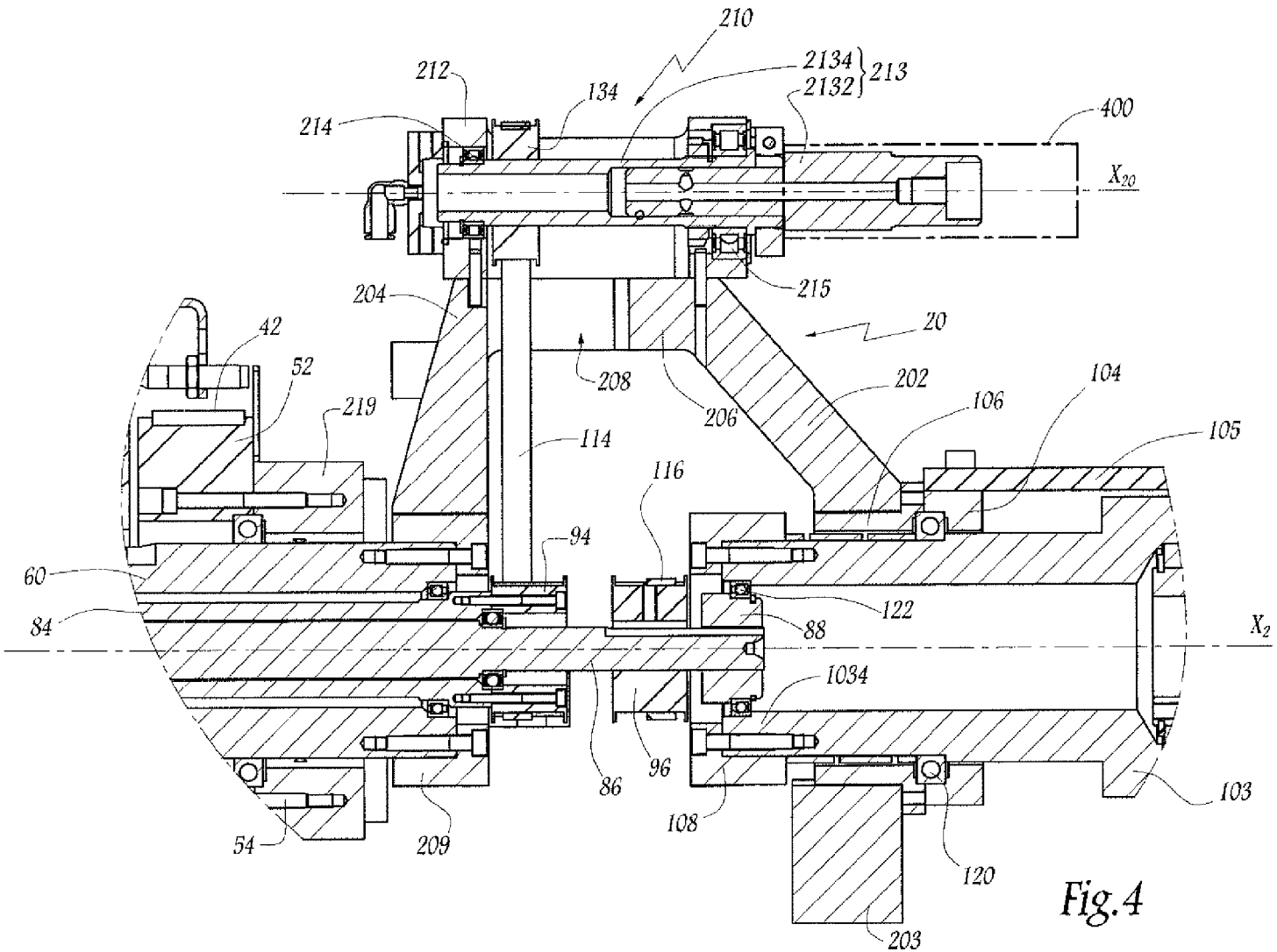
FIG. 4 is a view on a larger scale of the detail IV of FIG. 3.
Figure 5:
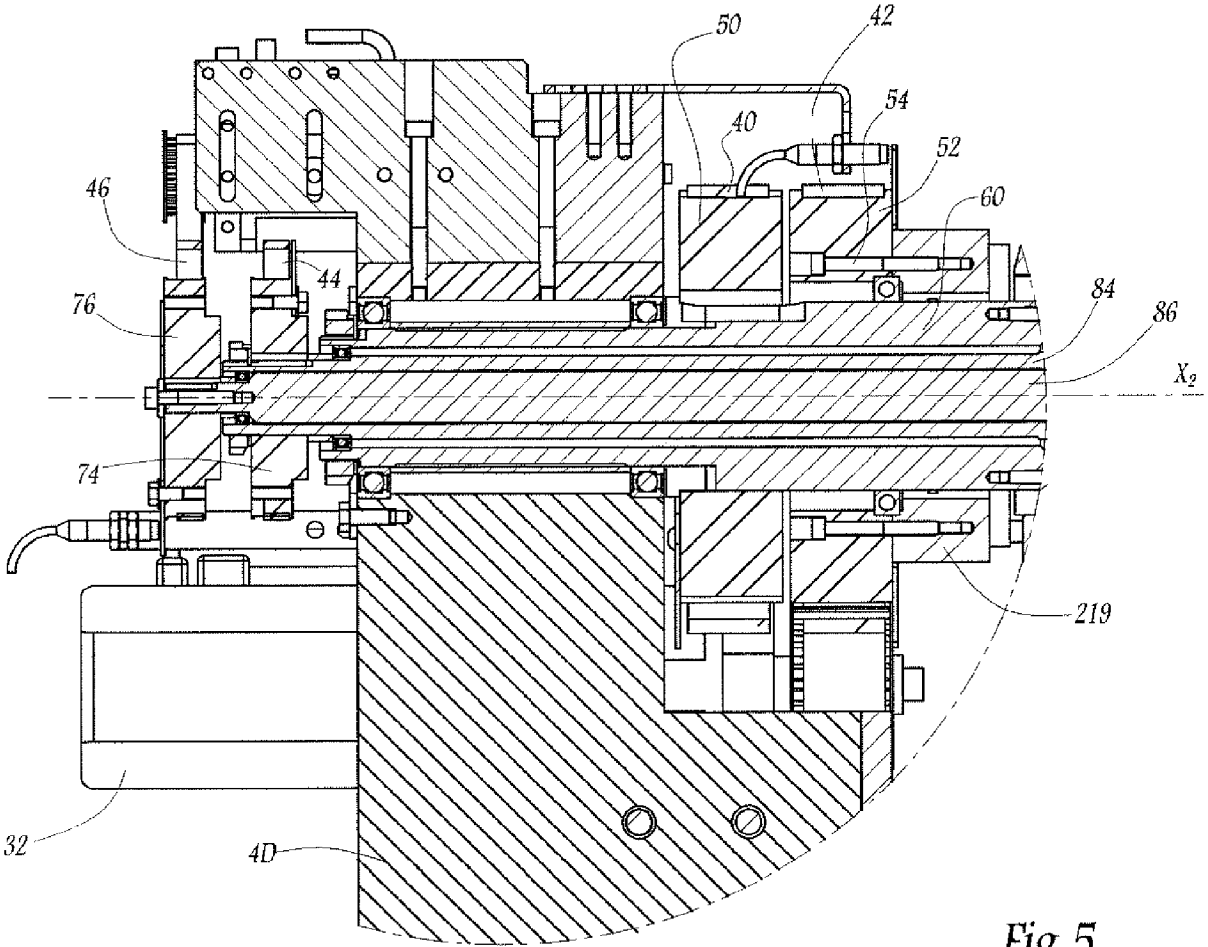
FIG. 5 is a view on a larger scale of the detail V of FIG. 3.

As appears more particularly from FIG. 4, the hollow core 213 is in two portions, and comprises a front portion 2132 and a back portion 2134.

The front portion 2132 is designed to be engaged into a workpiece for marking whose outline is shown in chain-dotted lines in FIG. 4 only, and with the reference 400.

At its end opposite from the piece of equipment 210, the arm 20 is equipped with a counterweight 203 that makes it possible to balance the effect of the arm 20 on the shaft 103.

The arm 22 has a structure comparable to the structure of the arm 20 and comprises a front plate 222, a back plate 224, and a plateau 226 provided with an opening that is not shown in the figures but that is comparable to the opening 208. A piece of equipment 230 is mounted on the arm 22 and comprises a housing 232, a two-portion core 233 and bearings comparable to the bearing 214 and 215. The arm 22 is mounted on a third ring 108 that is constrained to rotate with the end 1034 of the shaft 103 that is opposite from the core 101. A counterweight (not shown) equips the arm 22.

A brushless electric motor 30 is mounted on a mounting plate 4E that is part of the frame 4 and its outlet shaft is in engagement with a cog belt 40 that is wrapped around a cog band 50 keyed onto a hollow shaft 60 on which a support 209 is held stationary. The back plate 204 of the arm 20 is fastened to the support 209 by means of screws, one of which is visible in FIG. 1. Thus, energizing the motor 30 makes it possible to drive the arm 20 in rotation about the axis $X_2$.

In addition, a second brushless motor 32 is mounted on a mounting plate 4F that is part of the frame 4, and its outlet shaft engages a cog belt 42 that wraps around a cog band 52 that is secured by means of screws 54 to a support 219. The back plate 224 of the arm 22 is mounted on the support 219 by means of screws, only one of which is visible in FIG. 1. Thus, energizing the motor 32 makes it possible to cause the arm 22 to move in rotation about the axis $X_2$.

Since the motors 30, 32 can be powered independently from each other, the drive trains formed by these motors, by the cog belts, by the cog bands, and by the supports that are mentioned above, and by the shaft 60 when considering the arm 20, constitute independent drive means for driving each of the arms 20 and 22 in rotation about the axis $X_2$, independently of the other arm.

In addition, a third brushless motor 34 is supported by the frame 4 and its outlet shaft drives a belt 44 that is in engagement with a pulley 74 keyed to the end of a shaft 84 aligned on the axis $X_2$ and disposed radially inside the shaft 60. The end of the shaft 84 that is opposite from the pulley 74 carries a second pulley 94 around which a belt 114 is wrapped that goes via the opening 208 and that is also wrapped around a pulley 134 mounted around and constrained in rotation with the back portion 2134 of the hollow core 213. It is thus possible, by energizing the motor 34, to cause the elements 74, 84, 94, 114, 134, and 213 to turn so that the hollow core 213 turns about the axis $X_{20}$. This makes it possible to drive a workpiece for marking 400 about its longitudinal axis, when said workpiece is supported by the front portion 2132 of the core 213.

In the same manner, a fourth brushless motor 36 is supported by the frame 4 and drives a belt 46 that engages a pulley 76 that is mounted at a first end of a shaft 86 aligned on the axis $X_2$ and that is disposed radially inside the shaft 84. A second pulley 96 is fastened to opposite end of the shaft 86 and drives a belt 116 that is visible in the cutaway view of FIG. 2 and that travels around a pulley 136 that is constrained in rotation with the hollow core 233, thereby making it possible to drive said core in rotation about an axis $X_{22}$, parallel to the axes $X_2$ and $X_{20}$ and distinct therefrom.

The shaft 86 extends along the axis $X_2$ to the inside of the end 1034 of the shaft 103 where a band 88 is keyed to the shaft 86. A bearing 122 centers the shafts 86 and 103 mutually while enabling them to move in rotation relative to each other.

The drive means for driving the cores 213 and 223 in rotation respectively about the axes $X_{20}$ and $X_{22}$, are independent from each other insofar as they make it possible to drive one or the other of the cores 213 and 233 in rotation about the axes $X_{20}$ and $X_{22}$ or both of them, depending on whether the motor 34 or the motor 36 is energized or whether both of these motors are energized.

Since the motors 30 to 36 are supported by the frame 4, they are not moved while the arms 20 and 22 are being moved in rotation, so that the inertia of said arms is relatively small, thereby facilitating movements at high speed and limiting wear on the support parts such as the bearings.

In an optional aspect of the invention that is not shown, belt-tensioning idlers can be disposed along the paths of the belts, in particular along the paths of belts 114 and 116.

Figure 6:
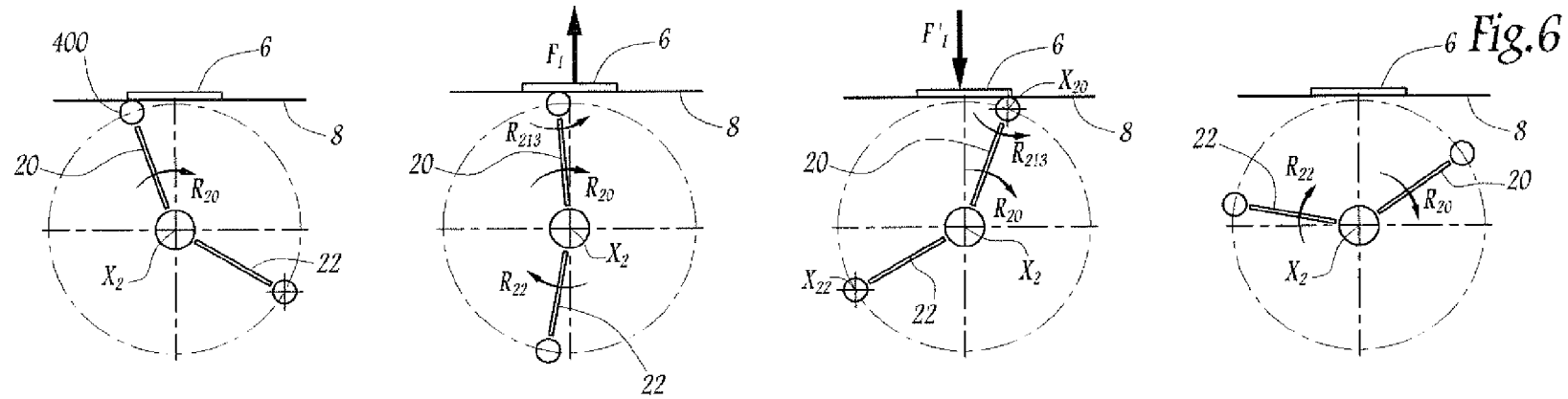
FIG. 6 is a diagram showing in principle, and as seen from the front, the positions of the arms and of the punch of the machine of FIGS. 1 to 5 while performing a marking method.

When a workpiece 400 is to be marked with the ribbon 8, said workpiece is mounted on one of the arms, e.g. the arm 20 and said arm is moved to the vicinity of the punch 6 in the direction indicated by the rotation arrow $R_{20}$ in the first view of FIG. 6. The arm 22 is stationary, in a position in which a workpiece previously loaded on the core 233 is unloaded from this arm, in an unloading station. By continuing the movement in rotation $R_{20}$, the arm 20 follows the upward movement of the punch 6 shown by arrow $F_1$ in the second view of FIG. 6. The punch 6 is motor-driven, thereby enabling it to adapt its height position to match the height positions of the workpieces for marking, so as to guarantee good contact. Meanwhile, the arm 22 can be moved towards a loading position for loading a workpiece 400 onto its shaft 233, at a speed that can be equal to or different from the speed of movement in rotation of the arm 20. During the portion of the movement of the arm 20 for which the workpiece 400 that it moves is in abutment against the ribbon 8, said workpiece is driven in rotation about the axis $X_{20}$, as indicated by the arrow $R_{213}$ in the second view of FIG. 6. In the third view, the arm 22 has reached a loading position in which a workpiece 400 can be engaged on the hollow core 233 while the arm 20 continues to move in rotation about the axis $X_2$, as indicated by the arrow $R_{20}$, in order to disengage from the punch 6 that moves radially towards the axis $X_2$ as indicated by the arrow F'1. In this configuration, the workpiece that is being marked is driven in rotation about the axis $X_{20}$, as indicated by the arrow $R_{213}$. In the fourth view of FIG. 6, the arm 22 is being moved so as to bring the workpiece that it carries into the marking configuration, as shown by the arrow $R_{22}$, while the arm 20 is being moved so as to bring the workpiece that it supports towards the unloading station, as indicated by the arrow $R_{20}$. The speeds of movement of the arms 20 and 22 during this step may be identical or different, as made possible by the independent drive means for driving the arms in rotation about the axis $X_2$.

Figure 7:
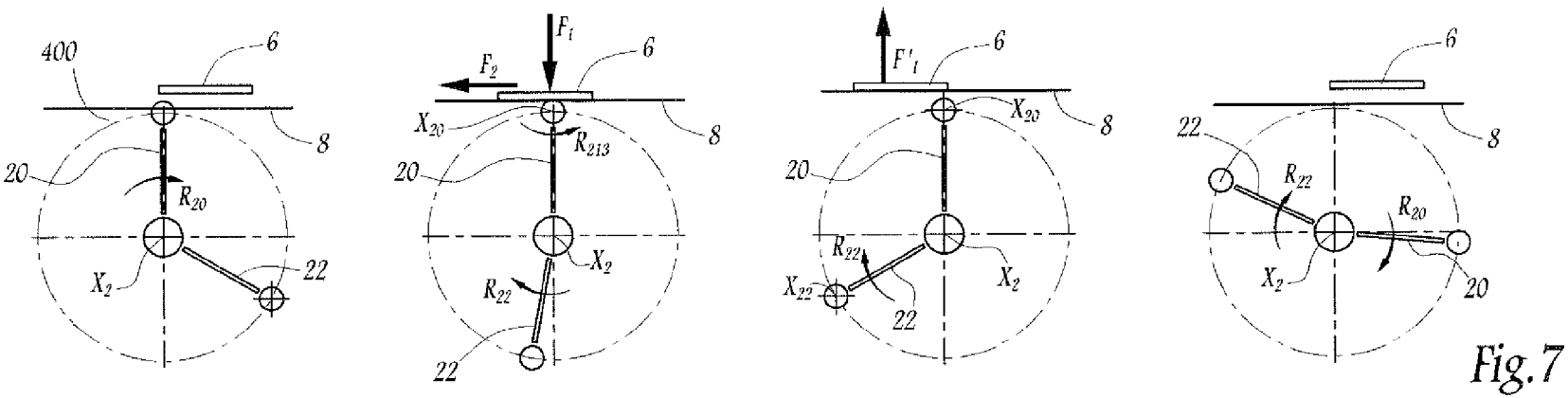
FIG. 7 is a diagram analogous to FIG. 6, for a variant of the marking method.

In the variant shown in FIG. 7, the arms 20 and 22 also have movements in rotation $R_{20}$ and $R_{22}$ that are independent from each other. In this embodiment, the arm 20 is held stationary during the marking of the workpiece 400 that it supports. In the first view of FIG. 7, the arm 20 is brought into a top position, in the vicinity of the punch 6, as indicated by the arrow $R_{20}$. Then, the punch is lowered, in the direction indicated by the arrow $F_1$, while the arm is held stationary, and then the punch 6 is moved horizontally, in the direction indicated by the arrow $F_2$ in the second view of FIG. 7, by rolling over the workpiece supported by the hollow core 213 which then turns about the axis $X_{20}$, as indicated by the arrow $R_{213}$. At the end of the marking, the punch 6 is moved away from the workpiece, as indicated by the arrow F'1 in the third view of FIG. 7.

During these movements, the movement in rotation of the arm 22 between the unloading station in which the arm is present in the first view and the loading position in which said arm is present in the third view takes place without requiring any additional time since it takes place within the time for which the arm 20 needs to be held stationary for the purpose of marking the workpiece that it carries. The arrow $R_{22}$ represents this movement in rotation.

In the last step of the method shown in FIG. 7, the arms 20 and 22 turn about the axis $X_2$, as indicated by the arrows $R_{20}$ and $R_{22}$, in order to bring the arm 22 into the position in which the arm 20 lies in the first view, and vice versa.

In a variant of the methods shown in FIGS. 6 and 7, it is possible to stop one of the arms 20 or 22 in the angular sector in which the arm 20 is shown in the fourth view of FIG. 6 in order to make it possible to inspect the marking performed on the workpiece, even while the arm 22 is moving to bring a workpiece into the vicinity of the punch 6. Similarly, it is possible to stop the arm 22 in the angular sector in which it is shown in the fourth view of FIG. 6 in order to identify where the marking is to be applied on the workpiece for marking. Other operations may be considered in these angular sectors, while the arm(s) 20 and/or 22 are stopped or are moving slowly.

In the second to fourth embodiments of the invention, shown in FIGS. 9 to 16, the elements that are analogous to the elements of the first embodiment bear like references. The description below concentrates mainly on what distinguishes these embodiments from the preceding embodiment.

In the second embodiment shown in FIGS. 9 to 13, the arm 20 is a double arm in that it comprises two portions 20A and 20B that extend on respective sides of the axis $X_2$ and each of which carries a respective hollow core 213A, 213B acting as a support member for receiving and moving a respective workpiece for marking.

In the same way, the arm 22 comprises two portions 22A and 22*b* that extend on either side of the axis $X_2$ and each of which carries a hollow core 233A and 233B forming a respective support for receiving and moving a respective workpiece for marking.

The arms 20 and 22 are not provided with counterweights in this example.

The arm portions 20A & 20B are integral with or secured to each other, as are the arm portions 22A & 22B, and said arm portions are driven in rotation in a manner comparable to the manner indicated for the first embodiment, by respective brushless motors 30 and 32 associated with belts 40 and equivalent. Similarly, two brushless motors 34 and 36 make it possible to drive the hollow shafts 213A, 213B, 233A and 233B respectively about their longitudinal axes $X_{20A}$, $X_{20B}$, $X_{22A}$, $X_{22B}$.

Figure 10:
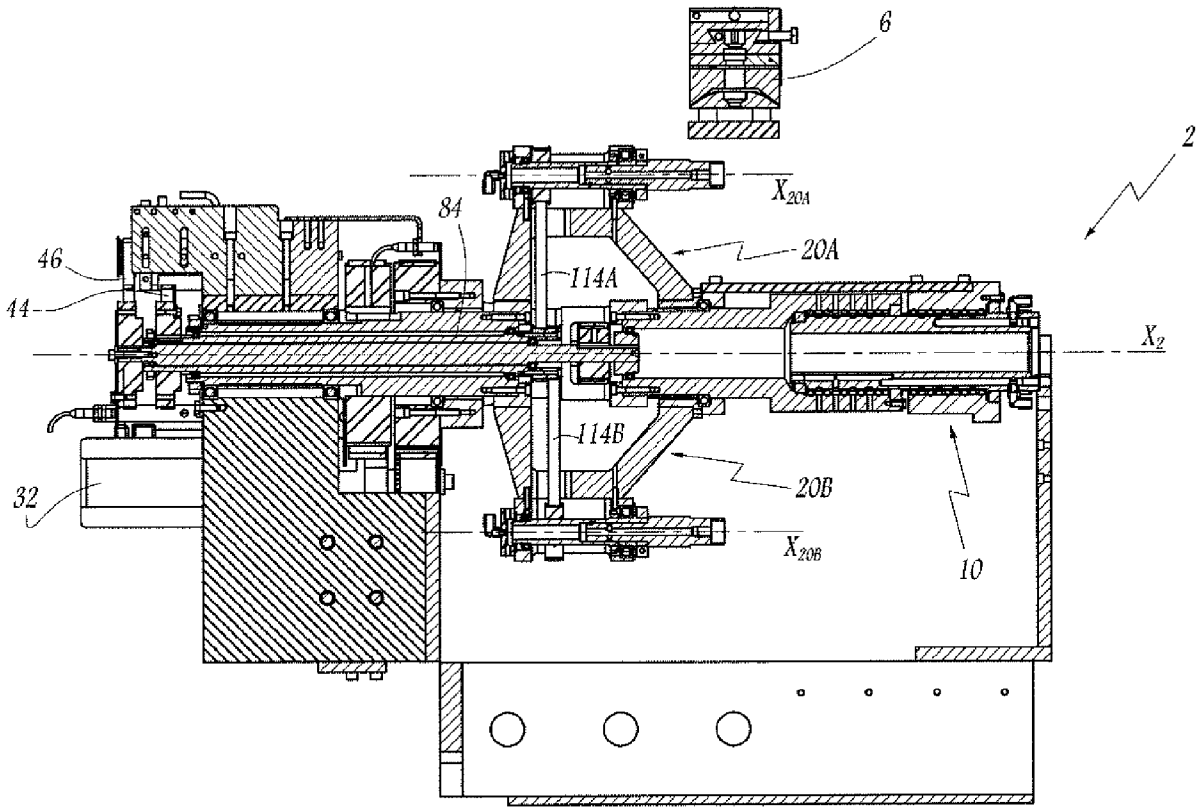
FIG. 10 is a longitudinal section view analogous to the FIG. 3 view, for the machine of FIG. 9.

As appears more particularly from FIG. 10, the shaft 84 driven in rotation by the motor 34 is equipped with a double pulley 94 that drives two belts 114A and 114B making it possible for the hollow cores 213A and 213B to be driven simultaneously about axes $X_{20A}$ and $X_{20B}$ that are parallel to the axis $X_2$. A similar construction is adopted for the arm 22.

Figure 11:
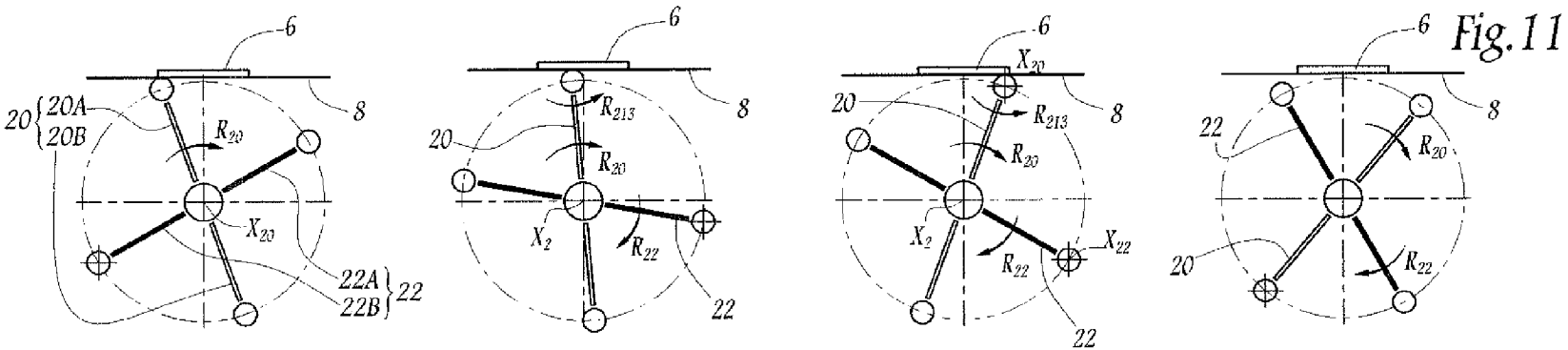
FIG. 11 is a diagram analogous to the FIG. 6 diagram, for the machine of FIGS. 9 and 10.

As appears more particularly from FIG. 11, it is possible to cause the arm 20 to turn so as to bring a workpiece 400 that it supports into contact with the punch 6, independently of whether or not the arm 22 is being moved in rotation. Since each of the arms 20 carries two support members formed by the hollow cores 213A and 213B, it is possible to bring workpieces supported by said arms into four distinct processing stations of the machine 2. Otherwise the method of FIG. 11 is comparable to the method of FIG. 6.

Figure 12:
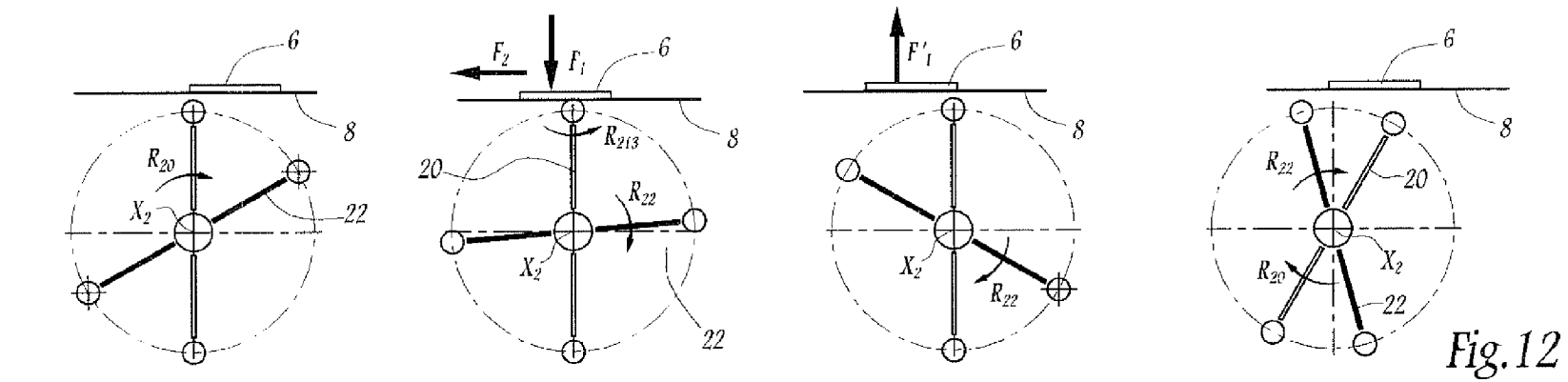
FIG. 12 is a diagram analogous to FIG. 11, for a variant of the marking method.

The method of FIG. 12 is comparable to the method of FIG. 7, the double arms making it possible to manipulate four workpieces simultaneously.

Figure 13:
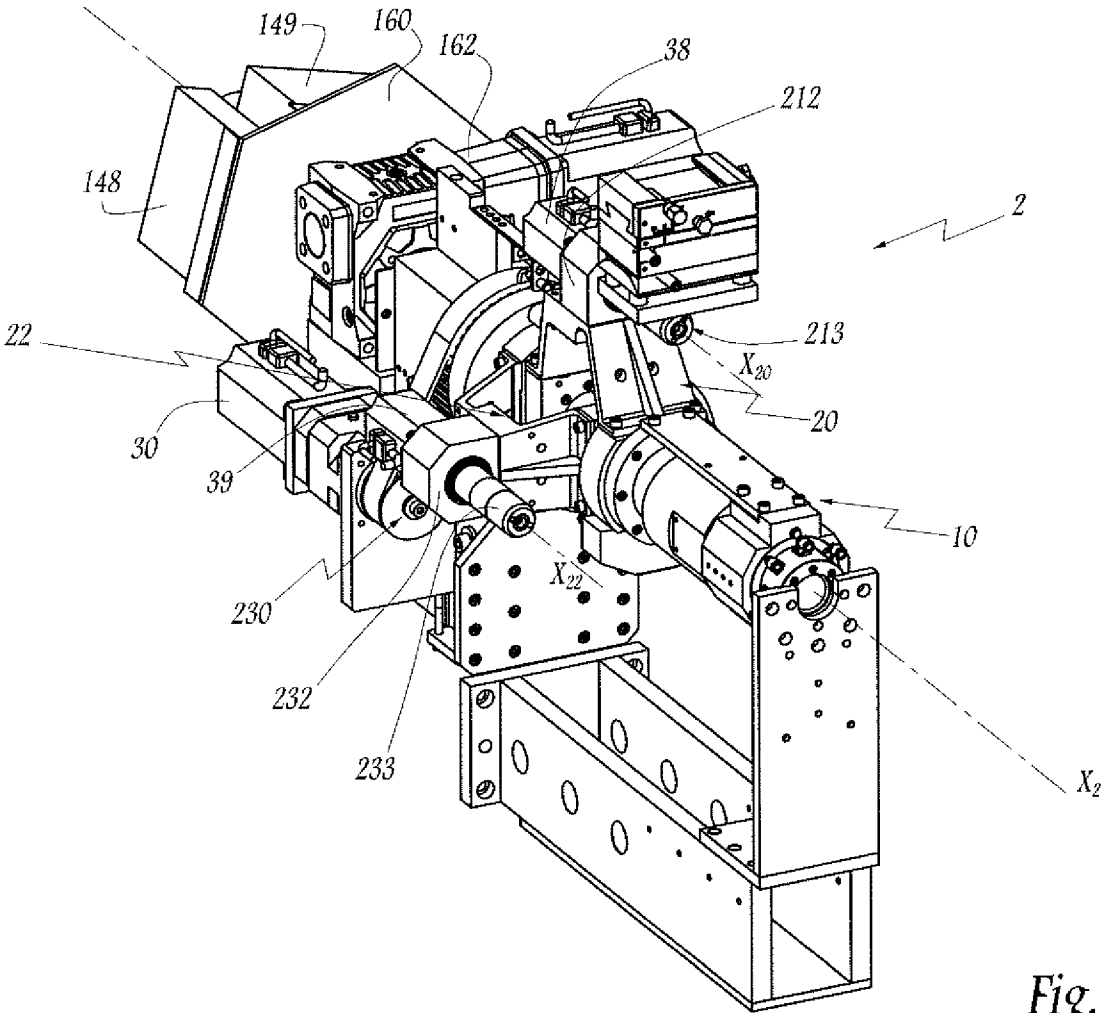
FIG. 13 is a perspective view analogous to FIG. 1, for a third embodiment of a machine of the invention.
Figure 14:
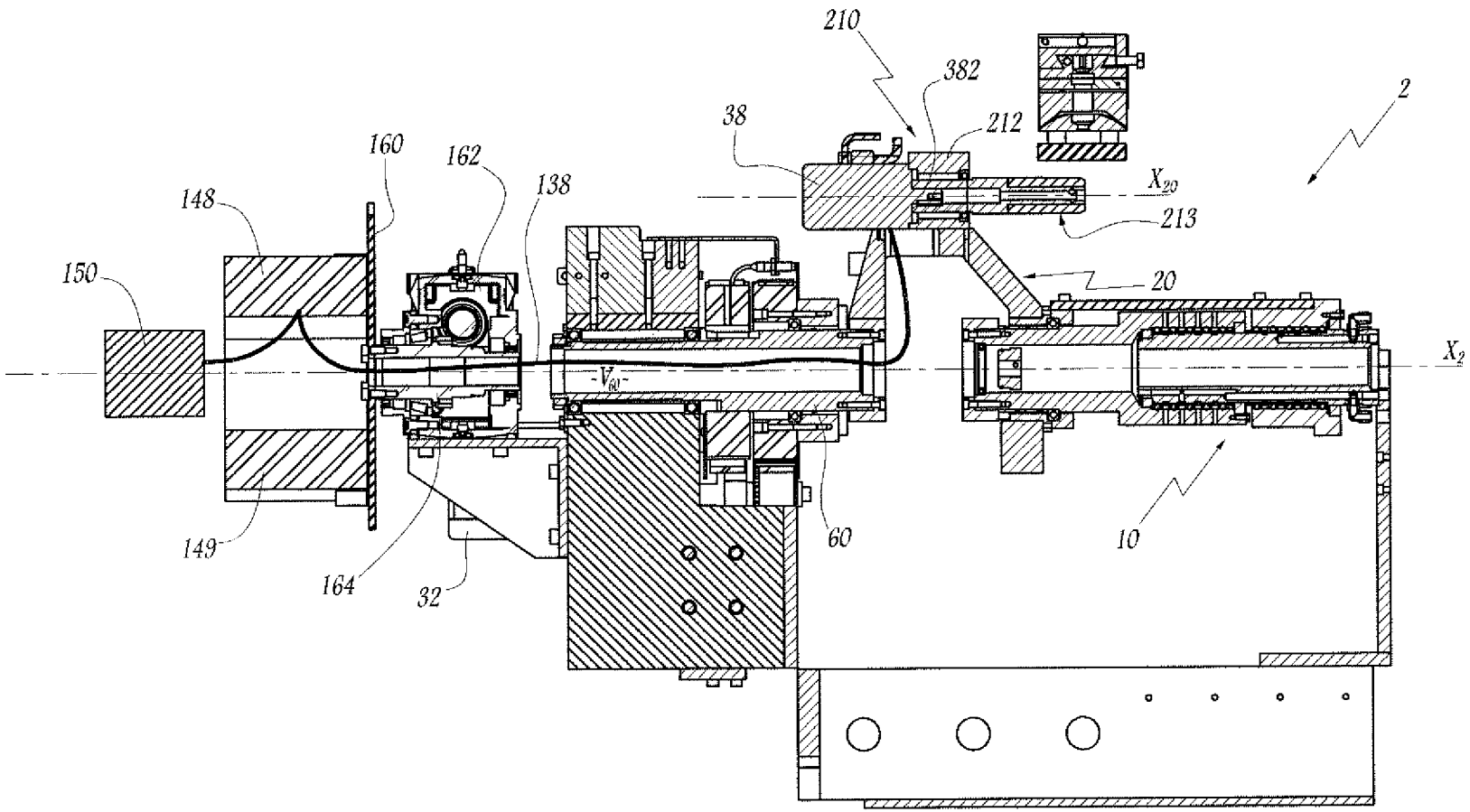
FIG. 14 is a longitudinal section view analogous to FIG. 3, for the machine of FIG. 13.

In the third embodiment of FIGS. 13 and 14, the motors 34 and 36 are replaced with brushless motors 38 and 39 mounted on respective ones of the arms 20 and 22, thereby making it possible for their respective outlet shafts 382 and equivalent to engage the hollow cores 213 and 233 directly. In practice, the motors 38 and 39 are fastened to the housings 212 and 232 of the pieces of equipment 210 and 230 respectively supported by arms 20 and 22.

Otherwise, brushless motors 30 and 32 analogous to the motors of the first embodiment are used, together with cog belts, for driving the shafts 20 and 22 in rotation about the axis $X_2$.

Each of the motors 38 and 39 is powered by means of an electric cable, the electric cable 138 of the motor 38 being visible in FIG. 14, whereas the cable powering the motor 39 is not shown, in order to make the drawing clearer. The electric cable goes via the central volume $V_{60}$ of the hollow shaft 60 used for driving the arm 20 in rotation about the axis $X_2$. The cable 138 extends between a rotary slip-ring assembly 150, forming a power source, and the motor 38, this slip-ring assembly itself being connected to the mains and to a control unit (not shown).

In order to lighten the moving masses that are moved by each arm 20 or 22, the variable-speed drive units 148 and 149 for controlling the motors 38 and 39 are mounted on a turntable 160 mounted to turn about the axis $X_2$. These variable-speed drive units 148 and 149 are uniformly distributed on the turntable 160. In practice, the cable 138 extends between the slip-ring assembly 150 and a variable-speed drive unit 148 and then from the variable-speed drive unit 148 to the motor 38. In order to prevent the cable 138 from being twisted while the machine 2 is being used for a relatively long period, or from being torn off from one of the variable-speed drive units 148 or from the motor 138, the turntable 160 is driven in rotation about the axis $X_2$ by means of a brushless motor 162 that engages a hollow shaft 164 at the centre of which the cable 138 also runs.

The turntable 160 is driven by the motor 162 at an angular velocity corresponding to the mean speed of movement of the arms 20 and 22 about the axis $X_2$. Thus, at the end of a turn of the arms 20 and 22, the turntable 160 resumes an angular position corresponding to its starting position relative to the arms 20 and 22. Under these conditions, the angular offset between the turntable 160 and the motors 38 and 39 remains relatively small, to the extent that there is no risk of it damaging the cable 138 or the corresponding cable that powers the motor 39.

Figure 15:
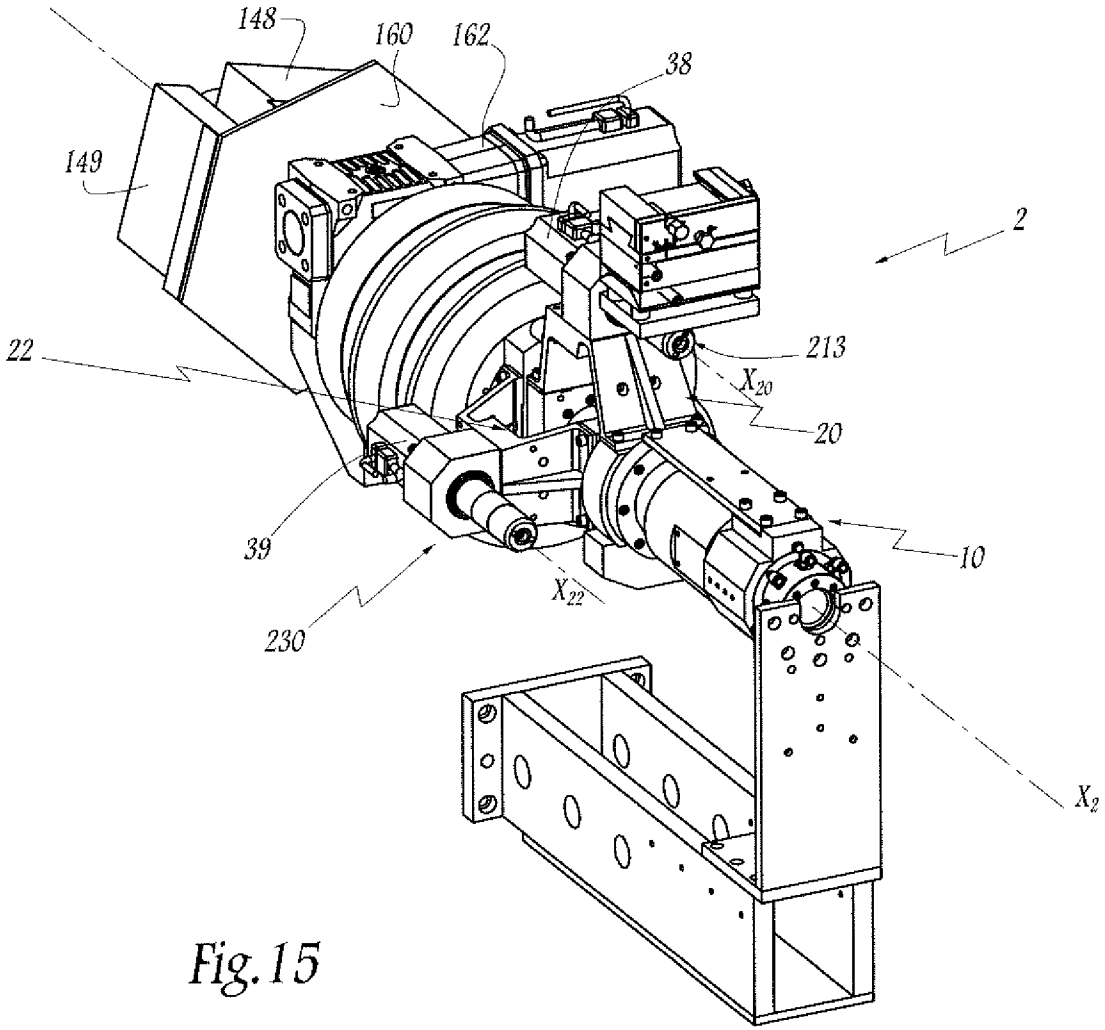
FIG. 15 is a perspective view comparable to FIG. 1, for a fourth embodiment of a machine of the invention.
Figure 16:
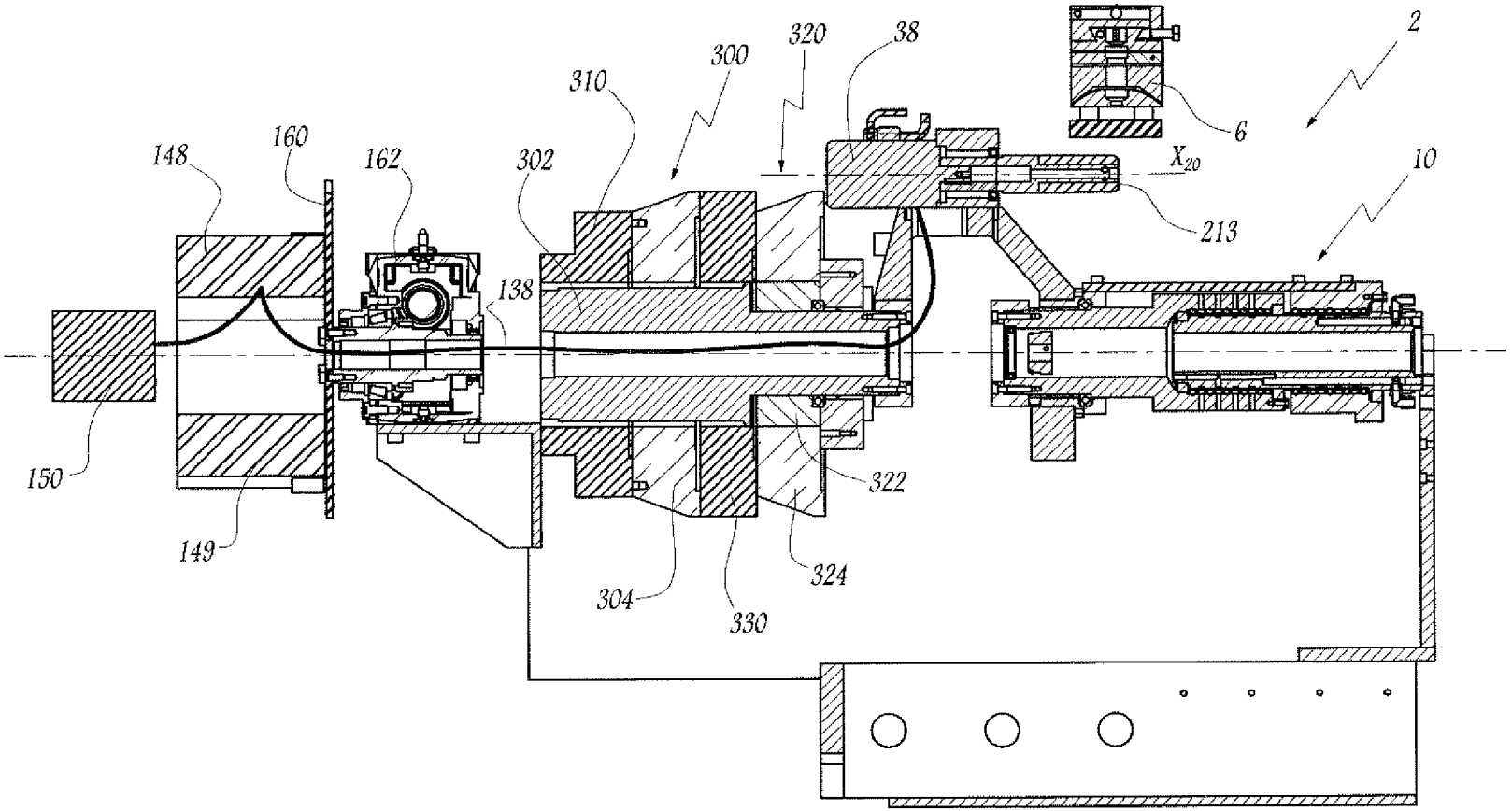
FIG. 16 is a longitudinal section view analogous to FIG. 3, for the machine of FIG. 15.

The embodiment shown in FIGS. 15 and 16 differs from the preceding embodiment in that, instead of the motors 30 and 32, two torque motors 300 and 320 are used, the rotors 302 and 322 of which are centered on the axis $X_2$. Each of the motors has a stator 304 or 324 capable of imparting drive torque to the rotors 302 and 322 for driving them in rotation at a speed compatible with the function of the arms 20 and 22 that are constrained to rotate with the rotors 302 and 322. Two supporting structures 310 and 330 form bearings for supporting at least one of the rotors, namely the rotor 302, it being specified that the rotor 322 is disposed radially around a portion of the rotor 302.

The motors 300 and 320 thus make it possible to drive the arms 20 and 22 independently from each other about the axis $X_2$ that is an axis of rotation that is common to the rotors 302 and 322. Cores 213 and 233 mounted at the ends of the arms 20 and 22 are driven about two axes $X_{20}$ and $X_{22}$ that are parallel to the axis $X_2$ by motors 38 and 39 that are analogous to the motors of the third embodiment.

In all of the embodiments, a rotary manifold 10 makes it possible to feed air to pneumatic members such as positioning actuators. For example, each arm 20 or 22 can be associated with an actuator making it possible to press a workpiece for marking onto the core 213 or 233. In addition, the hollow cores 213 and 233 can be fed with air so as to "inflate" a workpiece 400 before it is marked, in order to put its wall under tension.

Regardless of the embodiment, the invention makes it possible to position the various stations in which action is taken on the workpieces for marking in positions that are angularly spaced apart at an angular spacing that is not necessarily set at 60°, as in a prior art machine having a turntable. The angular spacing between the loading station and the zone in which the marking is applied to the workpiece may be different from the angular spacing between the marking zone and the unloading zone. In addition, the invention makes it possible to load an article on one of the arms 20 or 22 in all of the angular positions about the axis $X_2$, thereby making it possible to adapt the loading station to accommodate the geometrical shape of the workpieces to be marked.

The invention also makes it possible to drive a workpiece for marking in rotation about the axis $X_{20}$ or $X_{22}$, even though the arm 20 or 22 that supports it is still moving in rotation about the axis $X_2$, thereby making it possible to save time at the beginning of a marking step by means of the anticipation that is achieved. The accelerations to which the workpieces in movement are subjected can be reduced by means of this anticipation.

In a variant (not shown) of the invention, the punch used for marking the workpieces can be a punch that is not a hot punch.

In another variant (not shown), two or more marking members can be used because the arm can stop successively facing each of the marking members independently of the paths over which the other arms travel.

Arms each carrying two supports such as the shafts 213 and 233 can be used with the third and fourth embodiments, by applying the technical teaching of the second embodiment.

The number of arms of the machine may, in a variant, be greater than two.

As an alternative to the belts that form flexible links for driving the arms or the cores, it is possible to use chains.

The invention is described above as implemented when the marking takes place by means of a workpiece moving in rotation on its core. The invention may however be implemented in a machine in which the marking is performed by direct punching, on a plane face of an article. The invention may also be implemented in a machine for marking specially shaped workpieces, i.e. workpieces of non-circular section.

The invention is described above and shown in the accompanying figures for an embodiment in which it is applied to a marking machine which is entirely advantageous.

The invention may also be implemented for a screen-printing machine, in which case a workpiece for marking is to be moved facing an inked screen that forms a marking member, whose function is comparable to the above-mentioned punch 6.

The invention is also applicable, in another embodiment, to a labeling machine, and more precisely to a machine for applying labels, in which machine a web on which labels are disposed travels to the vicinity of workpieces to be labeled, while a presser member or applicator periodically presses the web against the outside surfaces of the workpieces to be labeled, in order to apply labels to said surfaces. The workpieces for labeling must be moved relative to the label applicator and the invention can be implemented for this purpose.

The invention claimed is:

1. A marking or labeling machine comprising at least one marking or labeling member, and a feed means for bringing workpieces for marking or labeling into register with the marking or labeling member, the feed means including at least two arms mounted to turn about a common first axis, and each arm carrying at least one support member for supporting a workpiece for marking or labeling;

wherein the feed means further includes independent first drive means for driving each of the arms in rotation about the common first axis independently of another arm, and second drive means for driving each support member in rotation about a second axis that is parallel to the common first axis.

2. The machine according to claim 1, wherein the independent first drive means includes at least two electric motors, each electric motor being dedicated to driving a respective arm in rotation about the common first axis, and the at least two electric motors are supported by a stationary frame of the machine.

3. The machine according to claim 1, wherein the second drive means for driving each support member includes one drive means for driving a support carried by a first arm in rotation about the second axis that is independent from another drive means for driving another support carried by a second arm in rotation about the second axis.

4. The machine according to claim 1, wherein the second drive means for driving a support member carried by an arm in rotation about the second axis includes a shaft centered on the common first axis and drivingly connected to an electric actuator and to the support member.

5. The machine according to claim 4, wherein the electric actuator is connected to at least one of the shaft and the support member by a flexible link.

6. The machine according to claim 1, wherein the second drive means for driving a support member carried by an arm in rotation about the second axis includes an electric motor mounted on the arm.

7. The machine according to claim 6, wherein the electric motor mounted on the arm is controlled by at least one control member mounted on a support that is mounted to turn about common the first axis, and wherein an electric actuator drives the support in rotation about the common first axis, at a speed equal to a mean of speeds of rotation of the arms over one rotation.

8. The machine according to claim 1, wherein at least one of the arms carries two support members for supporting respective workpieces for marking, on either side of the common first axis.

9. A marking or labeling method using a marking or labeling machine including at least one marking or labeling member and a feed means for bringing workpieces for marking or labeling into registry with the at least one marking or labeling member, the feed means including at least two arms mounted to turn about a common first axis, and each arm carrying at least one support member for supporting a workpiece for marking or labeling and wherein the feed means further includes independent first drive means for driving each of the at least two arms in rotation about the common first axis independently of another arm, and second drive means for driving each support member in rotation about a second axis that is parallel to the common first axis, and wherein the method includes bringing workpieces for marking or labeling successively into registry with the at least one marking or labeling member, wherein the method comprises steps of:

a) loading a workpiece onto a first support member carried by a first of the at least two arms mounted to turn about the common first axis;

b) causing the first arm on which the workpiece is loaded to turn about the common first axis until the workpiece comes into registry with the at least one marking or labeling member, independently of the movement of another arm of the at least two arms;

c) causing the first support member carried by the first arm and the workpiece loaded on the first support member to turn relative to the first arm about a second axis that is parallel to the common first axis;

d) marking the workpiece by using the at least one marking member, or affixing a label on the peripheral surface of the workpiece for labeling, by using the at least one labeling member;

e) causing the first arm to turn about the common first axis until the workpiece is at an unloading station, independently of the movement of another arm of the at least two arms; and f) unloading the marked or labeled workpiece from the first support member.

* * * * *